US010934809B2

(12) United States Patent
Becker

(10) Patent No.: US 10,934,809 B2
(45) Date of Patent: Mar. 2, 2021

(54) HYDROSTATICALLY ACTIVATED BALL-RELEASE TOOL

(71) Applicant: Becker Oil Tools LLC, Plano, TX (US)

(72) Inventor: Patrick Becker, Plano, TX (US)

(73) Assignee: Becker Oil Tools LLC, Plano, TX (US)

( * ) Notice: Subject to any disclaimer, the term of this patent is extended or adjusted under 35 U.S.C. 154(b) by 60 days.

(21) Appl. No.: 16/432,954

(22) Filed: Jun. 6, 2019

(65) Prior Publication Data

US 2020/0386076 A1 Dec. 10, 2020

(51) Int. Cl.
*E21B 41/00* (2006.01)
*E21B 43/116* (2006.01)
*E21B 33/12* (2006.01)

(52) U.S. Cl.
CPC ..... *E21B 41/00* (2013.01); *E21B 33/12* (2013.01); *E21B 43/116* (2013.01)

(58) Field of Classification Search
CPC ..... E21B 23/04; E21B 43/26; E21B 43/116; E21B 33/12; E21B 23/06; E21B 43/11; E21B 41/00; E21B 47/12; E21B 23/00; E21B 23/08; E21B 23/0413
See application file for complete search history.

(56) References Cited

U.S. PATENT DOCUMENTS 6,467,546 B2 10/2002 Allamon et al.
6,920,930 B2 7/2005 Allamon et al.
7,100,700 B2 * 9/2006 Davis ..... E21B 21/10 166/386
7,387,165 B2 6/2008 Lopez de Cardenas et al.
7,640,991 B2 1/2010 Leising
8,042,615 B1 * 10/2011 Wattenburg ..... E21B 33/06 166/373
9,593,560 B2 * 3/2017 Mailand ..... E21B 23/08
9,650,857 B2 * 5/2017 Mailand ..... E21B 43/116
9,719,321 B2 8/2017 Hern et al.
9,745,847 B2 * 8/2017 Ditzler ..... E21B 47/06
9,771,767 B2 * 9/2017 Sanchez ..... E21B 23/00
9,810,036 B2 * 11/2017 Mailand ..... E21B 43/119
9,879,499 B2 1/2018 Artherholt et al.
9,938,789 B2 * 4/2018 Silva ..... E21B 23/04
10,428,623 B2 * 10/2019 Silva ..... E21B 41/00
2013/0175053 A1 * 7/2013 Madero ..... E21B 34/14 166/387
2015/0068771 A1 3/2015 Richards et al.
2015/0068772 A1 3/2015 Richards et al.
2017/0175487 A1 6/2017 Marcin et al.

* cited by examiner

*Primary Examiner* — Michael R Wills, III
(74) *Attorney, Agent, or Firm* — D. Tiller Law PLLC; Donald Tiller

(57) ABSTRACT

A tool for deploying plug balls or frac balls in a borehole utilizing the hydrostatic pressure of fluid in the borehole is disclosed. The tool includes two connected cylinders, the first cylinder with a larger cross-sectional area than the second cylinder. The tool includes two connected pistons, the first piston disposed in sealing engagement within the first cylinder, the second piston disposed in sealing engagement within the second cylinder. The tool includes a ball-holding tube connected to the second cylinder. Application of force to the first piston by exposing the first cylinder to the hydrostatic head of the borehole fluid causes the second piston to move which in turn applies force to the balls in the ball-holding tube which deploys the balls into the borehole by ejecting them from the tube.

12 Claims, 5 Drawing Sheets

HYDROSTATICALLY ACTIVATED BALL-RELEASE TOOL

BACKGROUND

This invention pertains generally to technology for releasing balls in a wellbore. More specifically, the invention pertains to technology to enable downhole deployment of balls utilizing the hydrostatic pressure of the wellbore fluid. The balls may deployed to, for example, seat in a bridge plug (or frac plug) set in the borehole and thereby isolate the two stages of the borehole on either side of the plug.

Completion of oil/gas wells often involves pumping fluids into the hole under pressure to fracture the formation to ease production of the reservoir fluids. Often, different depth segments (stages or zones) of the well will be fractured independently. ("Depth" is used herein to denote the distance along the borehole from the surface. This may be different from "vertical depth" which denotes the distance at a particular point from the surface, regardless of the distance along the borehole. For example, different depths along a strictly horizontal portion of a wellbore will be at the same vertical depth.) Such independent fracturing of the various well depth stages requires hydraulic isolation of the stages.

Hydraulic isolation of depth stages may be accomplished using bridge or frac plugs. These are devices that are deployed to the appropriate depth in the borehole and are activated to expand to seal the borehole at that depth, and thus isolate the borehole section below the plug from the section above. ("Below" and "downhole" here means further along the borehole from the surface. "Above" and "uphole" here means further along the borehole toward the surface.) An expanded plug is said to be "set" in the borehole. A setting tool may be used to expand the plug.

Plugs may be ball activated (as used herein, "plug ball" and "frac ball" refer to the balls used to activate a borehole plug). A ball-activated plug includes a passage through the plug such that setting the plug does not in in itself cause the hydraulic isolation. Borehole fluid may flow through the passage from above the plug to below the plug (and vice versa, depending on the pressure profile). A plug ball may be dropped into a seat on the plug to block the passage to cause the hydraulic isolation. Plugs may be deployed into the borehole with a preseated ball (ball-in-place deployment) such that setting the plug causes the hydraulic isolation. Alternatively, ball-activated plugs may be set in the borehole without a ball, with the ball dropped into the borehole and pumped into the plug's seat only after the plug is set.

The main advantages of ball-in-place deployment is that it saves time and pump-down fluid. The isolation is completed once the plug is set, without the need for the extra time to drop the ball into the seat and without the need to use fluid to pump the ball into the seat. The main disadvantage of the ball-in-place deployment is that failure of other borehole operations may require retrieval of the ball to remove the hydraulic isolation so that the other operations may be properly completed.

The advantages and disadvantages become apparent when considering an exemplary completion operation. A typical borehole-completion operation includes deploying a plug, setting tool, and perforating guns into the borehole at the same time (e.g., on wireline connected to a control system on the surface). This may require using fluid to pump the tool string (the connected plug, setting tool, and perforating guns) to the appropriate depth in the borehole. This pump down is required, e.g., when the borehole is highly deviated off vertical, such as in a horizontal borehole. In the typical plug-and-perforation operation (often shortened to "plug-and-perf"), the setting tool is activated to set the plug, the perforating guns are fired to create holes ("perforations") in the borehole casing, and the tool string is then retrieved to the surface. Once the tool string is removed from the borehole, fracturing fluid (or "frac fluid") is pumped into the borehole and through the perforations to fracture the reservoir to ease production of fluids (e.g., oil or gas). For ball-in-place deployment of the plug, the fracturing operation begins right after the tool string is retrieved. Otherwise, a ball will have to be dropped into the borehole and pumped into the seat on the set plug before fracturing can begin. Thus, ball-in-place deployment saves time and pump-down fluid (and thus money). This savings is realized only if the perforating operation completes successfully. If the perforating operation fails (e.g., the guns do not fire properly), then the ball needs to be retrieved so that a substitute set of perforating guns may be pumped down. This is because it will not be possible to pump the tools down if there is not a flow path for the pump-down fluid. A ball in the plug's seat will block the flow path—it is what the ball is meant to do. Retrieval of the ball is time-consuming and may involve a fluid-intense, environmentally risky, and costly flow-back operation.

Accordingly, there is a need for technology to realize the benefits of ball-in-place operations without the risks of ball-in-place operations.

SUMMARY

The present invention is directed to downhole ball deployment wherein one or more balls are deployed (or "dropped") from a downhole tool using the hydrostatic pressure of the borehole fluid. This ball-release technology reduces the need for (and cost of) pump-down operations. And the ball-release technology can be configured to deploy the ball(s) only once certain conditions indicative of successful downhole operations have been met.

In one aspect of the invention, a ball-release tool includes two connected cylinders, the first cylinder with a larger cross-sectional area than the second cylinder. A first piston is disposed within the first cylinder in sealing engagement with the interior surface of the cylinder wall. A second piston is disposed within the second cylinder in sealing engagement with the interior surface of the cylinder wall. The first piston is connected to the second piston with a rod. The tool also includes a tube connected to the second cylinder, the tube is configured to hold plug balls. Application of pressure to the first piston forces the first piston to move thus moving the second piston to apply a force to balls disposed in the tube to eject the balls from the tube. The cylinders may be filled with a compressible fluid between the first piston and the second piston. The tube may be filled with a substantially incompressible fluid. The tube may terminate in a port of a tool housing that may be plugged with a stopper to isolate the tube from borehole fluid when the tool is disposed in a borehole. The stopper is configured to be pushed out of the port when pressure is applied to the first piston by, e.g., exposure the borehole fluid.

In another aspect of the invention, a method to plug a borehole is disclosed. The method involves disposing two piston-cylinder pairs in a borehole. The two pistons are connected through, e.g., a rod. The two cylinders are connected. The pistons are in sealing engagement with the cylinders through, e.g., O-rings placed on the pistons. By exposing the first of the two pistons to the hydrostatic pressure due to the borehole fluid, the second piston experiences a force. This force is used to deploy balls from a tube into the borehole. Fluid may be pumped into the borehole to move the deployed balls to plug a fluid passage in the borehole. For example, the balls may seat in a plug set in the borehole, thereby isolating the borehole below the plug from the borehole above the plug. Exposing the first of the two pistons to the hydrostatic head may be accomplished by firing a perforating gun that is disposed in the borehole along with the piston-cylinder pairs. A setting tool and ball-activated plug may also be disposed in the borehole and the setting tool used to set the plug before the perforating guns are fired. The deployed balls may then be seated in the set plug by pumping fluid into the borehole.

BRIEF DESCRIPTION OF THE DRAWINGS

These and other features, aspects, and advantages of the present invention will become better understood with reference to the following description, appended claims, and accompanying drawings where:

DETAILED DESCRIPTION

Figure 1:
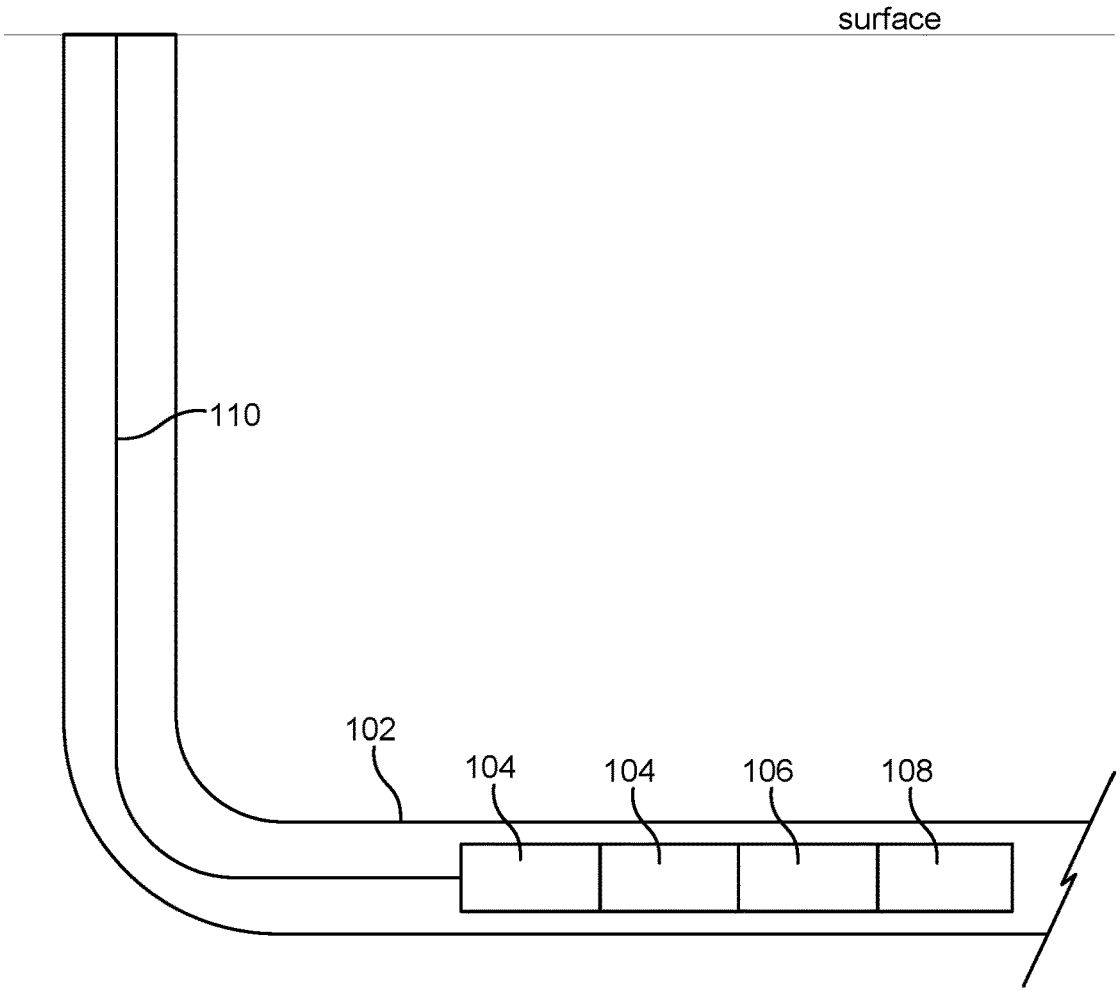
FIG. 1 (prior art)
FIG. 1 illustrates a stage of an exemplary wireline plug-and-perforation operation, according to the prior art.

In the summary above, and in the description below, reference is made to particular features of the invention in the context of exemplary embodiments of the invention. The features are described in the context of the exemplary embodiments to facilitate understanding. But the invention is not limited to the exemplary embodiments. And the features are not limited to the embodiments by which they are described. The invention provides a number of inventive features which can be combined in many ways, and the invention can be embodied in a wide variety of contexts. Unless expressly set forth as an essential feature of the invention, a feature of a particular embodiment should not be read into the claims unless expressly recited in a claim.

Except as explicitly defined otherwise, the words and phrases used herein, including terms used in the claims, carry the same meaning they carry to one of ordinary skill in the art as ordinarily used in the art.

Because one of ordinary skill in the art may best understand the structure of the invention by the function of various structural features of the invention, certain structural features may be explained or claimed with reference to the function of a feature. Unless used in the context of describing or claiming a particular inventive function (e.g., a process), reference to the function of a structural feature refers to the capability of the structural feature, not to an instance of use of the invention.

Except for claims that include language introducing a function with "means for" or "step for," the claims are not recited in so-called means-plus-function or step-plus-function format governed by 35 U.S.C. § 112(f). Claims that include the "means for [function]" language but also recite the structure for performing the function are not means-plus-function claims governed by § 112(f). Claims that include the "step for [function]" language but also recite an act for performing the function are not step-plus-function claims governed by § 112(f).

Except as otherwise stated herein or as is otherwise clear from context, the inventive methods comprising or consisting of more than one step may be carried out without concern for the order of the steps.

The terms "comprising," "comprises," "including," "includes," "having," "haves," and their grammatical equivalents are used herein to mean that other components or steps are optionally present. For example, an article comprising A, B, and C includes an article having only A, B, and C as well as articles having A, B, C, and other components. And a method comprising the steps A, B, and C includes methods having only the steps A, B, and C as well as methods having the steps A, B, C, and other steps.

Terms of degree, such as "substantially," "about," and "roughly" are used herein to denote features that satisfy their technological purpose equivalently to a feature that is "exact." For example, a component A is "substantially" perpendicular to a second component B if A and B are at an angle such as to equivalently satisfy the technological purpose of A being perpendicular to B.

Except as otherwise stated herein, or as is otherwise clear from context, the term "or" is used herein in its inclusive sense. For example, "A or B" means "A or B, or both A and B."

A typical plug-and-perforation operation may be better understood with reference to FIG. 1. A tool string comprising a ball-activated plug 108, a setting tool 106, and two perforation guns 104 is disposed within the casing 102 of a borehole. The tool string is attached to wireline 110 that is attached to a surface system comprising a winch and control unit (not shown) on the surface. This is customary in the art.

The tool string is placed into the horizontal portion of the borehole by pumping the string down through application of pressurized fluid at the surface. When in position, the plug 108 is set in the casing 102 using the setting tool 106. Then the perforating guns 104 are fired to perforate the casing 102. Then the tool string is returned to surface. This too is customary in the art.

Figure 2A:
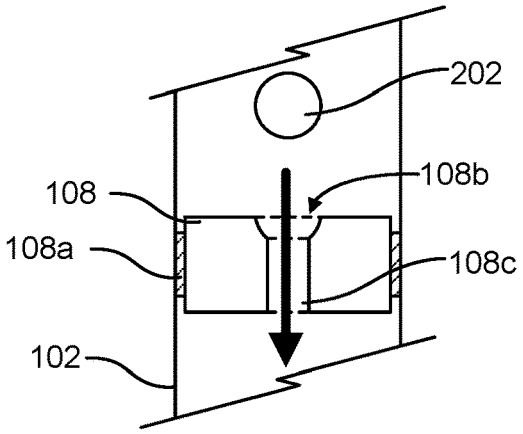
FIG. 2A (prior art)
FIGS. 2A-2B are simplified side sectional views illustrating a portion of an exemplary ball-activated plug set in a borehole, according to the prior art.
Figure 2B:
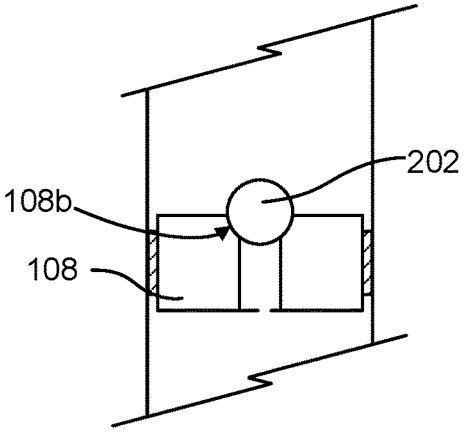
FIG. 2B (prior art)

Side-sectional views of a ball-activated plug 108 as set in the casing 102 are depicted in FIGS. 2A and 2B. (FIGS. 2A and 2B depict the casing 102 oriented vertically for sake of convenience. The casing 102 may in practice be oriented any direction.) The plug 108 includes a sealing element 108*a* that, when activated by the setting tool 106, expands to fill the annular gap between the plug 108 and the casing 102. The plug 108 also includes a fluid passage 108*c* that allows fluid to flow through the plug 108. An exemplary fluid flow is depicted with the thick arrow in FIG. 2A. At the top of the plug 108, the fluid passage 108*c* terminates in a ball seat 108*b* configured to hold a ball 202 such that the ball 202, when in the seat 108*b*, will prevent fluid flow. In FIG. 2B, the ball 202 is shown in the seat 108*b* such the fluid may no longer flow through the passage 108*c*. The ball 202 may be placed in the seat 108*b* by dropping the ball 202 in the borehole and pumping the ball 202 into the seat 108*b* through application of pressurized fluid at the surface causing a flow as depicted with the thick arrow in FIG. 2A. The ball 202 may alternatively be placed in the seat 108*b* before the plug 108 is deployed in the borehole (the "ball-in-place" deployment). This too is customary in the art.

Figure 3:
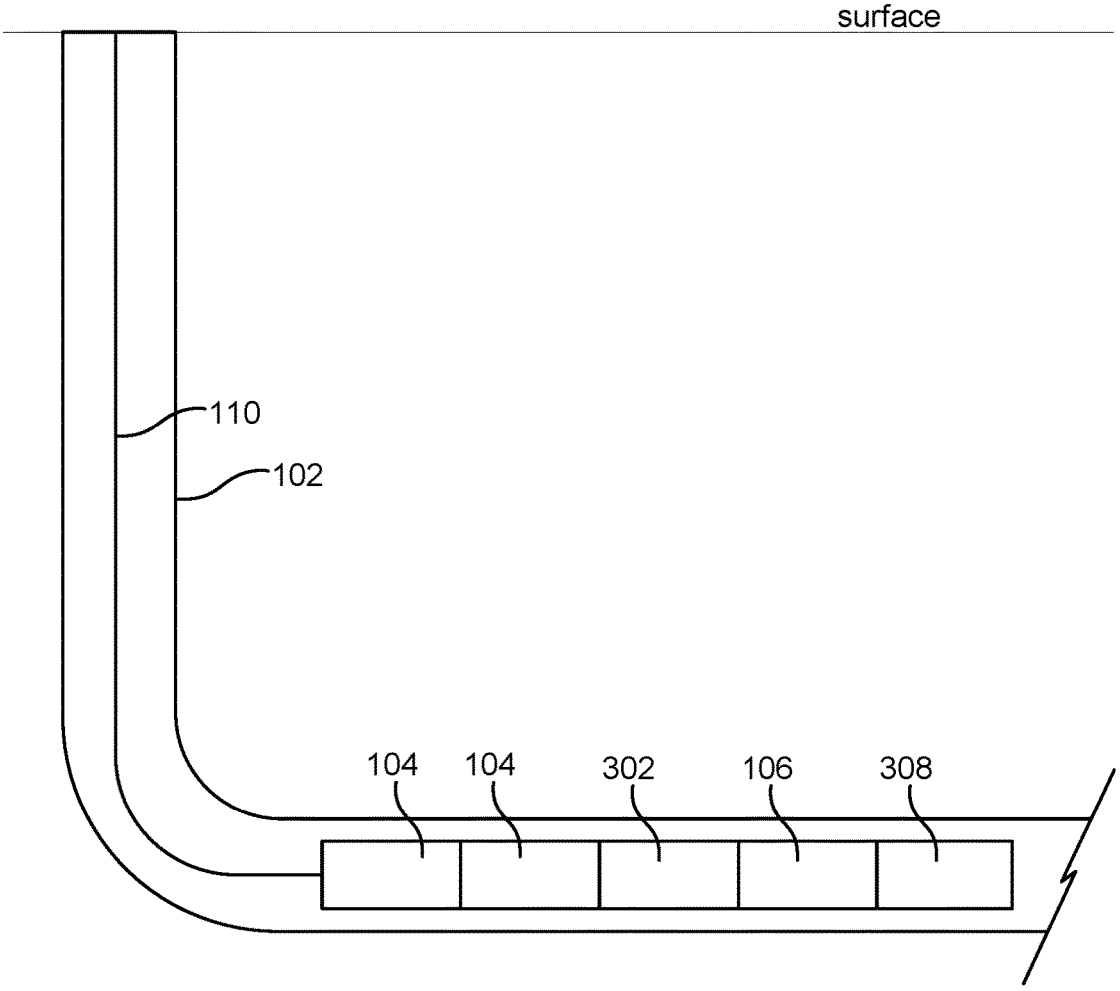
FIG. 3 illustrates a stage of an exemplary wireline plug-and-perforation operation according to an aspect of the invention.

A plug-and-perforation operation according to an aspect of the invention may be understood with reference to FIG. 3. A tool string comprising a ball-activated plug 308, a setting tool 106, a ball-release tool 302, and two perforation guns 104 is disposed in the casing 102 of a borehole. The tool string is attached to wireline 110 that is attached to a surface system comprising a winch and control unit (not shown) on the surface. The tool string is placed into the horizontal portion of the borehole by pumping the string down through application of pressurized fluid at the surface. When in position, the plug 308 is set in the casing 102 using the setting tool 106. Then the perforating guns 104 are fired to perforate the casing 102. If the perforating guns 104 properly fire, borehole fluid will enter the body of the guns 104 and will engage a hydraulic cylinder in the ball-release tool 302 and thereby release one or more balls from the ball-release tool 302. That is, the hydrostatic pressure (or "head") of the borehole fluid causes the ball-release tool 302 to release the balls, but only if the perforating gun 104 fires.

Figure 4A:
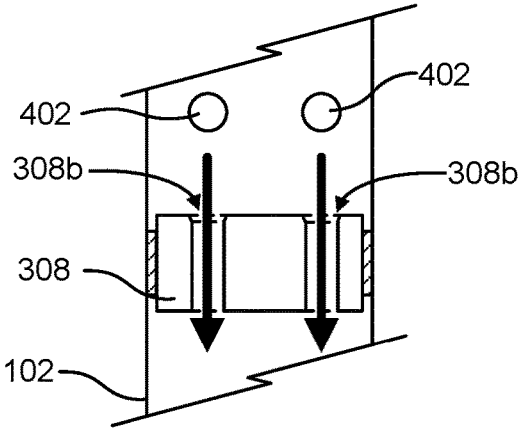
FIGS. 4A-4B are simplified side sectional views illustrating a portion of an exemplary multi-ball-activated plug set in a borehole.
Figure 4B:
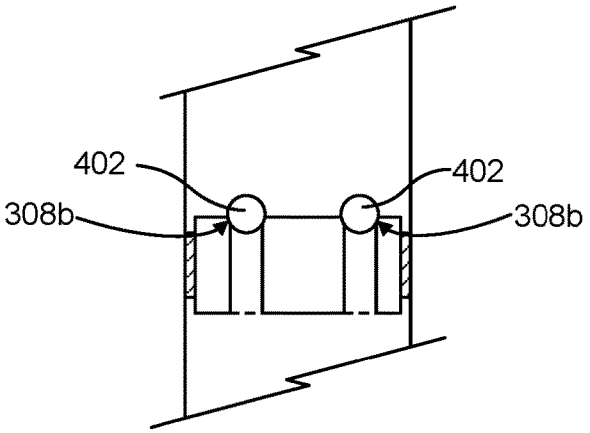

As depicted in FIGS. 4A-4B, the balls 402 released by the ball-release tool 302 are configured for the ball-activated plug 308 (in this instance, a two-ball-activated plug). (FIGS. 4A and 4B depict the casing 102 oriented vertically for sake of convenience. The casing 102 may in practice be oriented any direction.) FIGS. 4A-4B depict side-sectional views of the two-ball-activated plug 308 set in the casing 102. This multi-ball-activated plug 308 functions much the same as the single-ball-activated plug 108 depicted in FIGS. 2A-2B. The plug 308 provides fluid-flow passages terminating at two ball seats 308*b* at the top of the plug 308*b*. (The passages are shown here terminating at two openings on the bottom of the plug 308 but may equivalently terminate at a single opening or at more than two openings.) When seated in the seats 308*b*, the balls 402 will block the fluid-flow passages to seal the portion of the borehole above the plug from the portion of the borehole below the plug. The size of the balls 402 are selected to fit within the annular gap between the tool string and the casing 102.

Because the balls 402 are released by the ball-release tool 302 near the set plug 308, it requires less time and fluid to pump the balls 402 into the seats 308*b* of the plug 308 than if the balls were dropped from the surface. Because the balls 402 are released by the ball-release tool 302 only if the perforating gun 104 nearest to the ball-release tool 302 in the tool string fires and thereby allows borehole fluid into the body of the gun 104, there is less risk that a failed perforation firing results in a need to retrieve the balls 402 than if the plug 308 was set with the balls in place. If the perforating guns do not fire, the balls 402 will never be deployed and will therefore not be seated in the plug 308 to plug the borehole. The faulty perforating guns may be replaced without having to unplug the borehole to allow new tools to be pumped down.

Figure 5:
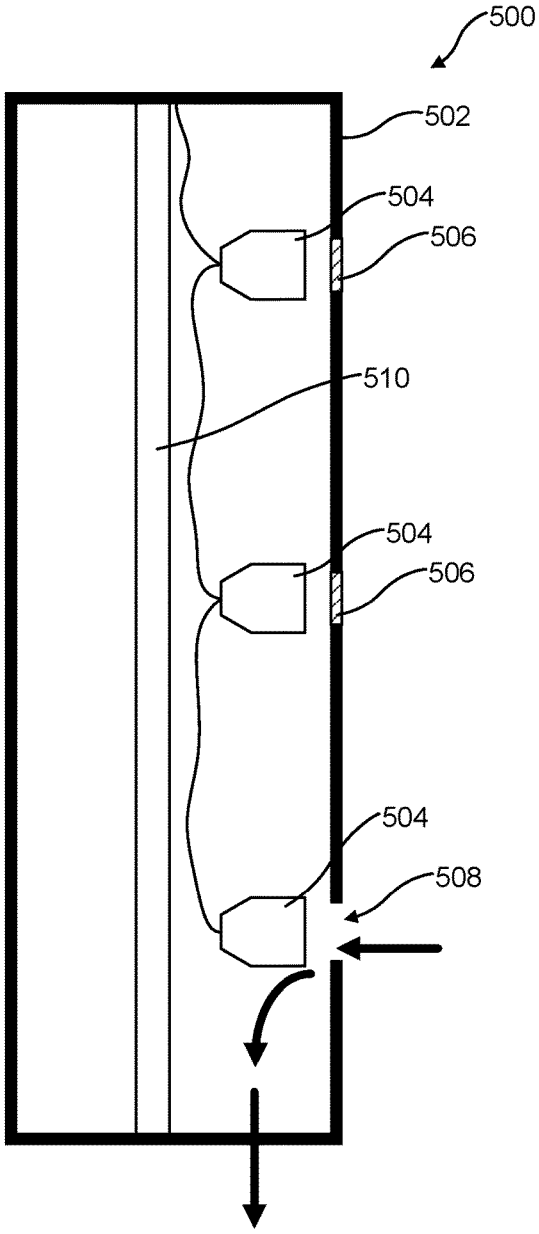
FIG. 5 is a simplified illustration of a perforating gun.

FIG. 5 depicts a view of an exemplary (simplified) perforating gun 500. (In the figure, the bottom of the gun 500 corresponds to the end of the gun that is oriented downhole of the surface when deployed in a borehole.) The gun 500 includes a housing 502 within which is disposed a number of perforating charges 504 adjacent to ports 508 in the housing 502. The ports 508 are plugged with a port plug 506 that will impede the exploding charge less than would the housing itself 502. Equivalently, the housing may be machined thinner at areas adjacent to the charges 504, forming spot faces or scallops that, like a port plug 506, will impede the exploding charge less than would the housing itself 502. In some instances, neither ports nor scallops are formed in the housing 502, and exploding charge will travel through the housing 502. In any event, firing the charges 504 results in holes in the housing 502 which allow borehole fluid to flow into the housing 502. Exemplary fluid flow into the gun is depicted with the thick arrows (this is for illustrative purposes only, absent a tool failure, a port will not be open unless the charges fire). Fluid flowing into a port 508 may flow out a pluggable port in the bottom of the tool housing (not shown). The gun 500 may include through wires or a tube 510 to contain through wires to allow control of tools below the gun 500 in the tool string (such as a setting tool or other perforating guns).

Figure 6:
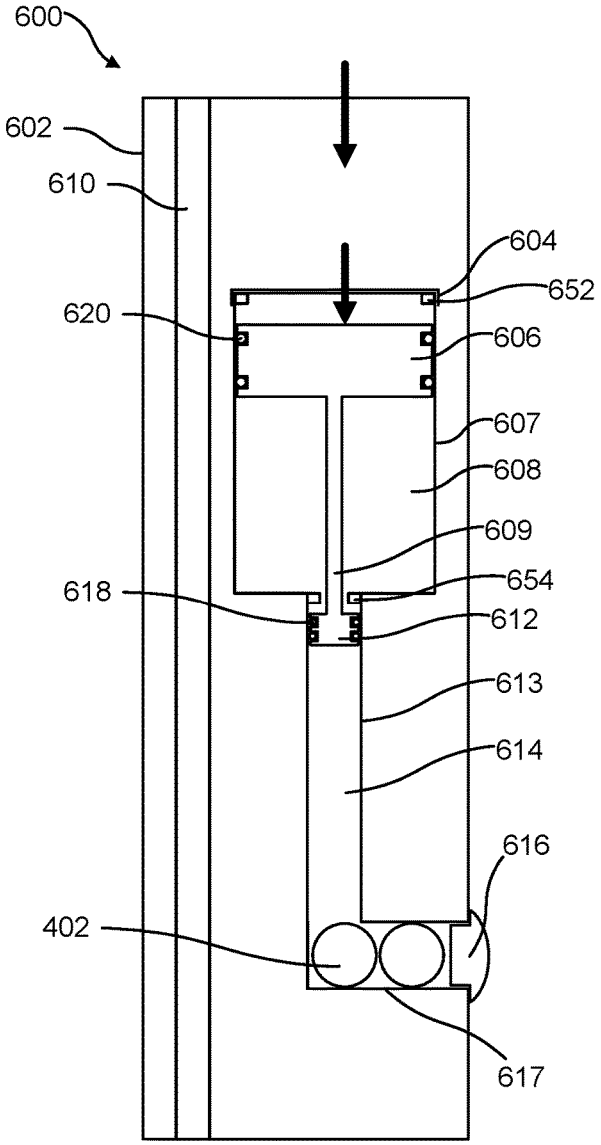
FIG. 6 is a side-sectional view illustrating an exemplary ball-release tool according to an aspect of the invention.

FIG. 6 depicts a side-sectional view of an exemplary ball-release tool 600 according to an aspect of the invention. (In the figure, the bottom of the tool 600 corresponds to the end of the tool 600 that is oriented downhole of the surface when deployed in a borehole.) The tool 600 includes a first cylinder 607. A first piston 606 is disposed within the first cylinder 607. The first piston 606 is in sealing engagement with the inner wall of the first cylinder 607. The seal may be facilitated by, e.g., one or more O-rings 620. One end of the first cylinder 607 is open (the upper end in the figure), the other end (lower in the figure) is connected to a second cylinder 613 having a smaller diameter than the first cylinder 607. A second piston 612 is disposed within the second cylinder 613. The second piston 612 is in sealing engagement with the inner wall of the second cylinder 613 through, e.g., one or more O-rings 618. The first piston 606 and the second piston 612 are connected together with a rod 609 such that movement of one piston effects movement of the other.

The open end of the first cylinder 607 may include a retaining cap 604 or rib 652 above the first piston 606 that is configured to provide a travel stop beyond which the first piston 606 may not travel. The travel stop is configured such that the first piston 606 always remains in sealing engagement with the first cylinder 607. (For example, the O-ring(s) 620 on the first piston will always remain in contact with the inner wall of the first cylinder 607.) The rod 609 is configured such that the second piston 612 always remains in sealing engagement with the second cylinder 613. (For example, the O-rings 618 on the second piston will always remain in contact with the inner wall of the second cylinder 613.)

A rib 654 may be provided in the second cylinder 613 to stop the second piston 612 from exiting the second cylinder 613 into the first cylinder 607. This may be in addition to or instead of the retaining cap 604 or rib 652 provided in the first cylinder 607.

At the end of the second cylinder 613 that is not connected to the first cylinder 607, the second cylinder 613 is connected to a ball-holding tube 617 in which one or more plug balls 402 may be disposed. The ball-holding tube 617 terminates at a port in the housing 602 of the tool 600. The port may be plugged with a stopper 616.

Figure 9:
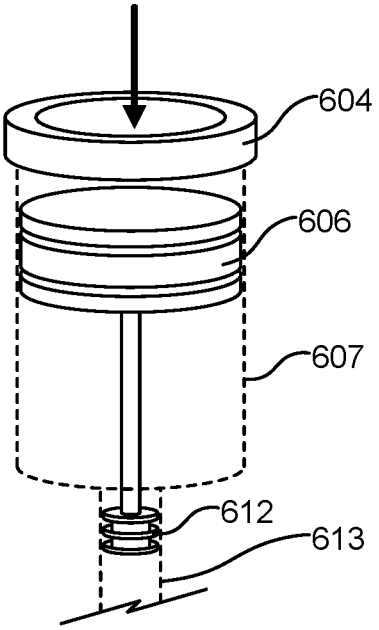
FIG. 9 is a perspective view illustrating a portion of a set of two piston-cylinder pairs of an exemplary ball-release tool according to an aspect of the invention.

FIG. 9 provides a perspective view of a portion of the first cylinder 607 and second cylinder 613 with an exemplary retaining cap 604 installed on the top of the first cylinder 607. (The walls of the cylinders 607, 613 are shown with dashed lines to represent that the illustration is depicting parts disposed within the cylinders 607, 613. O-rings are omitted from the drawing for sake of simplicity.) The retaining cap 604 is toroidal in shape, with a middle hole to allow fluid to pass into the first cylinder 607 on the top side of the first piston 606. The travel stop formed by the retaining cap 604 (or rib) is designed to prevent flooding of the tool if the stopper 616 fails.

The volume between the first piston 606 and the second piston 612 and contained by the first cylinder 607 and the second cylinder 613 is filled with a compressible fluid 608, such as air. The volume that is between the second piston 612 and the stopper 616 and contained by the second cylinder 613 and the ball-holding tube 617 is filled with a substantially incompressible fluid 614 such as water or oil.

Pressure applied to the upper surface of the first piston 606 (the surface facing toward the open end of the first cylinder 608) provides a force tending to move the first piston 606 toward the second cylinder 613. For example, exposure to the hydrostatic pressure of the borehole fluid (shown in thick arrows) will provide a downward force to the first piston 606. Because the volume between the first piston 606 and the second piston 612 is filled with a compressible fluid, and because the diameter of the first piston 606 is larger than the diameter of the second piston 612, and because the volume between the second piston 612 and the stopper 616 is filled with a substantially incompressible fluid, hydrostatic pressure from borehole fluid applied to the first piston 606 will cause the first piston 606 and second piston 612 to move down and push the stopper 616 out of the ball-holding-tube port in the housing 602 and push the ball(s) 402 out the tool 600.

The ball-release tool 600 may include through wires or a tube 610 to contain through wires to allow control of tools below the ball-release tool 600 in the tool string (such as a setting tool).

While the embodiment of FIG. 6 is described with circular cylinders 607, 613 and pistons 606, 612, shapes other than circular will function equivalently.

Figure 7:
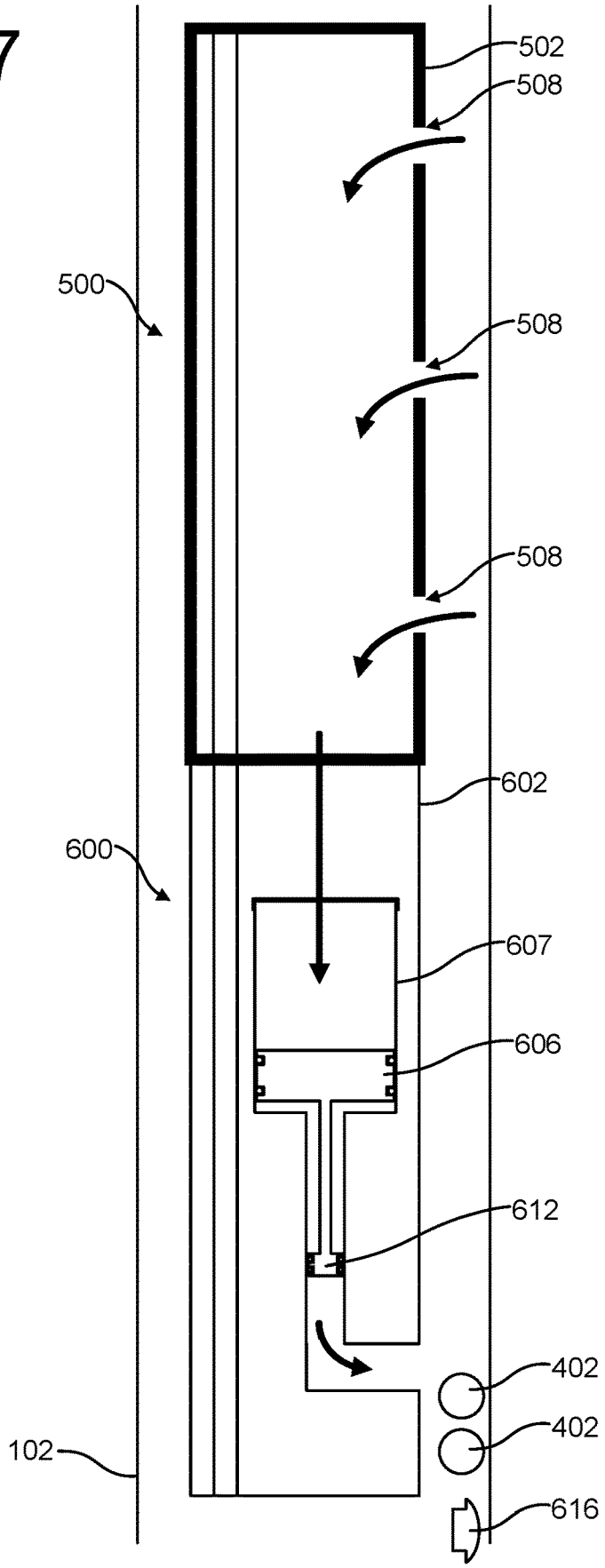
FIG. 7 is a side-sectional view of portions of an exemplary plug-and-perforation tool string according to an aspect of the invention.

FIG. 7 depicts an exemplary tool string comprising the perforating gun 500 stacked on top of the ball-release tool 600 disposed in casing 102 in a borehole. This figure depicts the gun 500 after is has been fired, and ports 508 opened (or created) in the gun housing 502. (Casing perforations are omitted for sake of simplicity.) Borehole fluid has flowed into the gun 500 (as depicted with thick arrows) and through to the open end of the first cylinder 607 of the ball-release tool 600. This caused the first and second pistons 606, 612 to move down which caused the stopper 616 and ball(s) 402 to be pushed out of the ball-release tool 600 and into the annulus between the tool 600 and casing 102. The balls 402 are thus are in close proximity to the plug (not shown) and are ready to be pumped into the ball seats (as described above). Fluid may be pumped downhole during the perforating operation, which would encourage the balls 402 to move downhole toward a plug set below the ball-release tool 600. The ball-release tool 600 may be pulled uphole, e.g., via wireline, during the perforating operation, which would encourage the balls 402 to drop/remain downhole relative to the ball-release tool 600. The stopper 616 may be configured such that application of pressurized fluid will cause the deployed stopper 616 to pass through a plug. For example, the stopper 616 may comprise a material enabling it to tear or deform to fit through the passage(s) in the plug when fluid is pumped into the borehole. Alternatively, the stopper 616 may be configured to seat in the plug to block a passage, thereby functioning as a ball to activate the plug.

Figure 8:
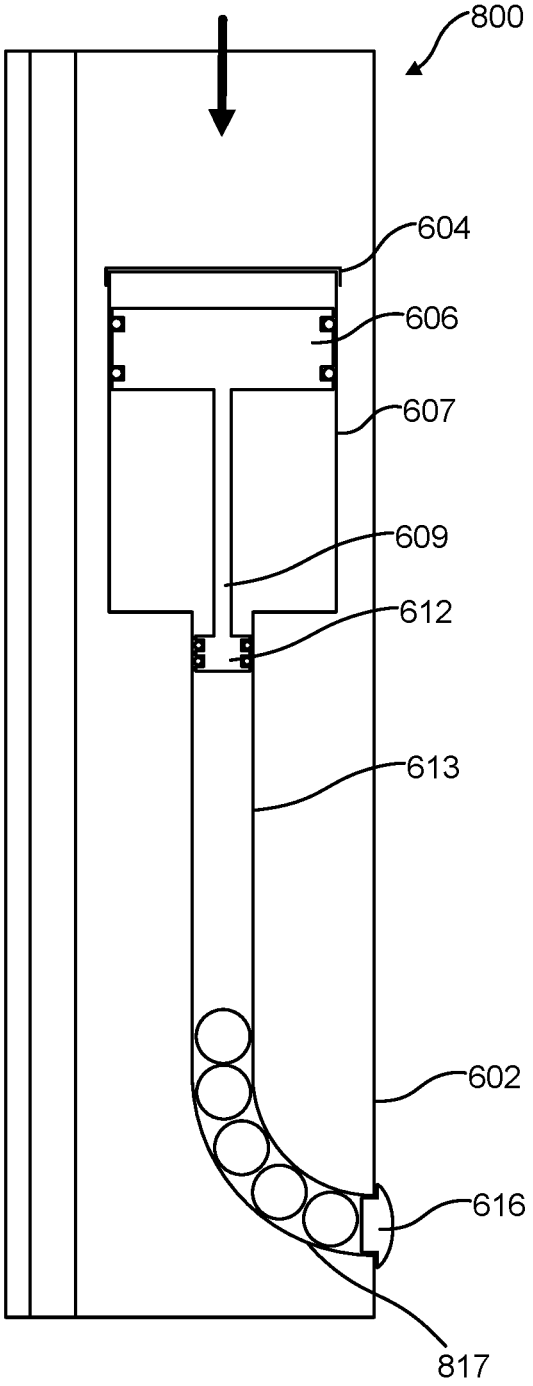
FIG. 8 is a side-sectional view illustrating an exemplary ball-release tool according to an aspect of the invention.

Another exemplary ball-release tool 800 is depicted in FIG. 8. The difference between this tool 800 and the tool 600 depicted in FIG. 6 is the ball-holding tube. The ball-holding-tube 817 in tool 800 is curved. In general, a ball-holding tube is not limited to any particular orientation or shape, so long as it connects to the second cylinder 613 and a port in the housing 602 and can hold balls configured for the ball seats in the plug.

While the foregoing description is directed to the preferred embodiments of the invention, other and further embodiments of the invention will be apparent to those skilled in the art and may be made without departing from the basic scope of the invention. And features described with reference to one embodiment may be combined with other embodiments, even if not explicitly stated above, without departing from the scope of the invention. The scope of the invention is defined by the claims which follow.

The invention claimed is:

1. A ball-release tool comprising:

(a) a first cylinder having a first end, a second end, and a first cross-sectional area;

(b) a second cylinder having a first end, a second end, and a second cross-sectional area, wherein the second cross-sectional area is smaller than the first cross-sectional area;

(c) a first piston disposed in the first cylinder, wherein the first piston is in sealing engagement with the first cylinder;

(d) a second piston disposed in the second cylinder, wherein the second piston is in sealing engagement with the second cylinder and is connected to the first piston;

(e) a ball-holding tube having a first end and a second end, the ball-holding tube configured to hold one or more plug balls;

(f) wherein the first cylinder is open at the first cylinder's first end;

(g) wherein the first cylinder's second end is connected to the second cylinder's first end; and (h) wherein the second cylinder's second end is connected to the ball-holding tube's first end.

2. The ball-release tool of claim 1 further comprising a stopper disposed within the second end of the ball-holding tube.

3. The ball-release tool of claim 1 further comprising a compressible fluid disposed within the first and second cylinders between the first and second pistons.

4. The ball-release tool of claim 1 further comprising a substantially incompressible fluid disposed within the ball-holding tube.

5. The ball-release tool of claim 1 wherein the first cylinder and the second cylinder are each circular cylinders.

6. The ball-release tool of claim 1 further comprising a travel stop.

7. A method for plugging a borehole, the method comprising:

(a) disposing within a borehole a ball-release tool comprising a first piston in a first cylinder, a second piston in a second cylinder, and a plug ball in a ball-holding tube, wherein the first piston is connected to the second piston; and (b) exposing the first cylinder to fluid within the borehole such that the borehole fluid pushes on the first piston and thereby moves the second piston to deploy the plug ball out of the ball-holding tube.

8. The method of claim 7 wherein the step of exposing the first cylinder to the borehole fluid includes firing a perforating gun.

9. The method of claim 7 further comprising applying pressurized fluid to the borehole to move the deployed plug ball within the borehole.

10. The method of claim 7 further comprising:

(a) disposing a setting tool in the borehole;

(b) disposing a perforating gun in the borehole;

(c) disposing a plug in the borehole;

(d) activating the setting tool and thereby setting the plug in the borehole; and (e) firing the perforating gun and thereby exposing the first cylinder to fluid within the borehole.

11. The method of claim 10 further comprising applying pressurized fluid to the borehole in order to seat the plug ball in the plug.

12. The ball-release tool of claim 6 wherein the travel stop includes at least one of the group consisting of a rib on the inside of the first cylinder, a rib on the inside of the second cylinder, and a retaining cap at the first end of the first cylinder.

* * * * *